US009562380B2

(12) United States Patent
Song

(10) Patent No.: US 9,562,380 B2
(45) Date of Patent: Feb. 7, 2017

(54) FLEXIBLE HINGE DEVICE HAVING COOPERATIVE OPERATING STRUCTURE

(71) Applicant: Prexco Co., Ltd, Nonsan-si (KR)

(72) Inventor: In-Sung Song, Siheung-si (KR)

(73) Assignee: Prexco Co., Ltd, Nonsan-si (KR)

( * ) Notice: Subject to any disclaimer, the term of this patent is extended or adjusted under 35 U.S.C. 154(b) by 0 days.

(21) Appl. No.: 14/786,992

(22) PCT Filed: Jul. 2, 2015

(86) PCT No.: PCT/KR2015/006830

§ 371 (c)(1),
(2) Date: Oct. 26, 2015

(65) Prior Publication Data

US 2016/0362918 A1 Dec. 15, 2016

(51) Int. Cl.
*E05D 15/00* (2006.01)
*E05D 7/00* (2006.01)
*E05D 1/00* (2006.01)

(52) U.S. Cl.
CPC ..... *E05D 1/00* (2013.01)

(58) Field of Classification Search
CPC ..... Y10T 16/547; Y10T 16/5474; Y10T 16/5475; Y10T 16/541; G06F 1/168; G06F 1/1681; G06F 1/1616; G06F 1/547; E05Y 2900/602; E05Y 2900/606; H04M 1/022; H04M 1/0214; H04M 1/0216; E05D 3/12; E05D 3/122; E05D 3/14; E05D 3/16; E05D 3/06; E05D 11/06; E05D 7/00; E05D 7/06
See application file for complete search history.

(56) References Cited

U.S. PATENT DOCUMENTS 3,680,927 A * 8/1972 Neureuther ..... B23Q 11/085 16/267
6,223,393 B1 * 5/2001 Knopf ..... G06F 1/1681 16/366
9,013,864 B2 * 4/2015 Griffin ..... H04M 1/0216 16/382
9,268,372 B1 * 2/2016 Hsu ..... G06F 1/1681
2007/0117600 A1 * 5/2007 Robertson, Jr. ..... H04M 1/0216 455/575.3
2010/0232100 A1 * 9/2010 Fukuma ..... F16G 13/18 361/679.01
2014/0126133 A1 * 5/2014 Griffin ..... G06F 1/1652 361/679.27

(Continued)

FOREIGN PATENT DOCUMENTS

KR 10-2010-0112383 10/2010
KR 10-1467857 12/2014

*Primary Examiner* — Chuck Mah

(57) ABSTRACT

The present invention relates to a flexible hinge device having a cooperative operating structure, comprising: a first plate and a second plate each having a top surface to which a flexible display screen having flexibility is attached; and a hinge unit configured to interconnects the first plate and the second plate and configured to be operated in a foldable manner so as to be bent or stretched, wherein the hinge unit comprises a plurality of segmental members connected to one another to allow the hinge unit to be bent or stretched, the first plate and the second plate are respectively coupled to the outermost segmental members positioned at both ends of the plurality of segmental members.

9 Claims, 9 Drawing Sheets

(56) References Cited

U.S. PATENT DOCUMENTS

| | | | | |
|---|---|---|---|---|
| 2014/0174226 | A1* | 6/2014 | Hsu | E05D 3/122 74/98 |
| 2014/0196253 | A1* | 7/2014 | Song | G06F 1/1601 16/225 |
| 2014/0196254 | A1* | 7/2014 | Song | E05D 3/14 16/302 |
| 2014/0217875 | A1* | 8/2014 | Park | H05K 5/0226 312/326 |
| 2015/0176317 | A1* | 6/2015 | Lee | E05D 3/06 16/251 |
| 2015/0277506 | A1* | 10/2015 | Cheah | G06F 1/1681 361/679.27 |

* cited by examiner

FLEXIBLE HINGE DEVICE HAVING COOPERATIVE OPERATING STRUCTURE

RELATED APPLICATIONS

This application is a National Phase of PCT Patent Application No. PCT/KR2015/006830 having International filing date of Jul. 2, 2015, which claims the benefit of priority of Korean Patent Application No. 10-2015-0082058 filed on Jun. 10, 2015. The contents of the above applications are all incorporated by reference as if fully set forth herein in their entirety.

FIELD AND BACKGROUND OF THE INVENTION

Technical Field

The present invention relates to a flexible hinge device having a cooperative operating structure. More particularly, the present invention relates to such a flexible hinge device having a cooperative operating structure which can reduce a difference in length between the first and second plates and the flexible display screen using only a configuration of the hinge unit without an additional variable means, and can bend each of the segmental members constituting the hinge unit at the same angle.

Background Art

In general, along with the development of a communication technology and a semiconductor and an optical technology, recently, a portable terminal such as a smartphone, a tablet PC or the like which enables the Internet access by improving a cellular phone is highly in the spotlight. The use of the portable terminal changes all the living environments of the human beings, which brings about a revolution in the science and technology. In particular, the tablet PC has an advantage in that it has a wide display screen, but still entails a shortcoming in that it is large in volume and is inconvenient to carry.

In an effort to improve this problem, a flexible display having flexibility has been proposed. As a prior art relating to such a flexible display substrate which is capable of being folded and stretched, a flexible display substrate has been disclosed in Korean Patent Laid-Open Publication No. 10-2010-0112383. The flexible display refers to a display which can be rolled in a roll shape or can be folded or bent like paper, and is free in the design of an outer appearance thereof. In addition, since the substrate has flexibility and thus is easily not broken, the flexible display is strong in strength. Further, the flexible display can be considered to be a display which employs a thin and lightweight substrate.

Meanwhile, the most basic type of the flexible display will be a type which can be carried in a state in which the flexible display is folded to half to cause the volume thereof to be reduced to half. Even in this case, the flexible display cannot be folded at right angle like a sheet of paper, and it is preferably to fold the flexible display in a shape having a gentle curvature.

As a device configured to fold the flexible display as described above, a foldable flexible display device with a load formation means has been disclosed in Korean Patent Registration No. 10-1467857.

The flexible display device separately includes a variable means composed of a movable plate disposed on a large area of the rear surfaces of the first and second plates and connected to a hinge member, and a guide member that guides the forward and rearward movement of the movable plate in order to solve a problem of the occurrence of a difference in length between first and second plates and a flexible display screen attached to the top surfaces of the first and second plates when a hinge unit is bent.

However, the conventional flexible display device entails a problem in that the first and second plate is increased in thickness and the configuration thereof is also complicated.

SUMMARY OF THE INVENTION

Accordingly, the present invention has been made to solve the aforementioned problems occurring in the prior art, and an object of the present invention is as follows.

A first object of the present invention is to reduce a difference in length between first and second plates and a flexible display screen, which occurs generally when a hinge unit is bent, using only a function of the hinge unit without an additional constituent element.

A second object of the present invention is to reduce the thickness of a flexible hinge device and the manufacturing cost by excluding an additional constituent element for reducing the above-described step.

A third object of the present invention is to bend each of segmental members constituting a hinge unit at the same angle by interconnecting the segmental members using a plurality of tension members.

A fourth object of the present invention is to further reinforce the cooperative operability in which each of segmental members is bent at the same angle by additionally coupling a plurality of link members to pins.

The objects to be achieved by the present invention are not limited to the above-mentioned objects, but other objects that are not mentioned will be clearly understood by a person of ordinary skill from the following description.

To achieve the above object, the present invention provides a flexible hinge device having a cooperative operating structure, including: a first plate and a second plate each having a top surface to which a flexible display screen having flexibility is attached; and a hinge unit configured to interconnects the first plate and the second plate and configured to be operated in a foldable manner so as to be bent or stretched. The hinge unit includes a plurality of segmental members connected to one another to allow the hinge unit to be bent or stretched, the first plate and the second plate are respectively coupled to the outermost segmental members positioned at both ends of the plurality of segmental members. Each of the segmental members includes: a longitudinally extended cam part; a pair of opposed fixing parts extendingly formed inwardly of both ends of the cam part in such a manner as to be spaced apart from each other by a uniform interval; a pair of opposed fixing members each including a head and a pin longitudinally extending from one end of the head; and a pair of rotary parts extendingly formed outwardly of one ends of the fixing members in such a manner as to be spaced apart from each other by a uniform interval.

The cam part may include: one or more cam noses continuously formed protrudingly at an upper portion thereof in such a manner as to be spaced apart from each other at uniform intervals; and one or more cam holes formed at a lower portion thereof to vertically correspond to the cam noses.

Each of the cam holes may include: an insertion hole formed at an upper portion thereof so as to allow a cam nose of another cam part connected to a lower portion of the cam part to be inserted into the insertion hole; a flexure formed at the central portion thereof so as to allow the cam nose to slide along the flexure; and a seating hole formed at a lower portion thereof so as to allow the cam nose to be seated in the seating hole.

The cam part may include: one or more upper fixing grooves formed between the cam noses; one or more lower fixing grooves formed between the cam holes; and one or more tension members interconnects the upper fixing grooves and the lower fixing grooves of the cam part, which are positioned in proximity to the upper fixing grooves.

The tension members may interconnect the upper fixing grooves positioned in even or odd rows and the lower fixing grooves positioned in even or odd rows of the cam part in proximity to the upper fixing grooves.

The head may be coupled to the front surface of the fixing part so as to allow the pin to be oriented outwardly.

The rotary part may include: a through-part having a through-hole formed therein; and a stepped part formed at an outer lower portion of the through-part. The stepped part may include an elongated hole formed therein to have a gentle curve.

The pin may be rotatably inserted into an elongated hole of a stepped part of another rotary part connected to the upper portion of the through-part through the through-hole.

In the flexible hinge device, one or more link members may be rotatably coupled to the pins between the heads and the through-parts to form a continuously constant layer. Each of the link members may include a vertical part and an inclined part extending inclinedly downwardly from a lower portion of the vertical part. The vertical part may include: a first elongated hole formed at an upper portion thereof so as to allow a pin of a fixing member positioned above the fixing member to pass through the first elongated hole; and a central hole formed at a lower portion thereof so as to allow the pin to pass through the central hole. The inclined part may include a second elongated hole formed therein so as to allow a pin of a fixing member positioned below the fixing member to pass through the second elongated hole.

The flexible hinge device in accordance with the present invention as constructed above has the following advantages.

It is possible to reduce a difference in length between first and second plates and a flexible display screen, which occurs generally when a hinge unit is bent, using only a function of the hinge unit without an additional constituent element.

In addition, each of segmental members constituting a hinge unit can be bent at the same angle by interconnecting the segmental members using a plurality of tension members. Further, the cooperative operability can be further reinforced by additionally coupling a plurality of link members to pins.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF SPECIFIC EMBODIMENTS OF THE INVENTION

Figure 1:
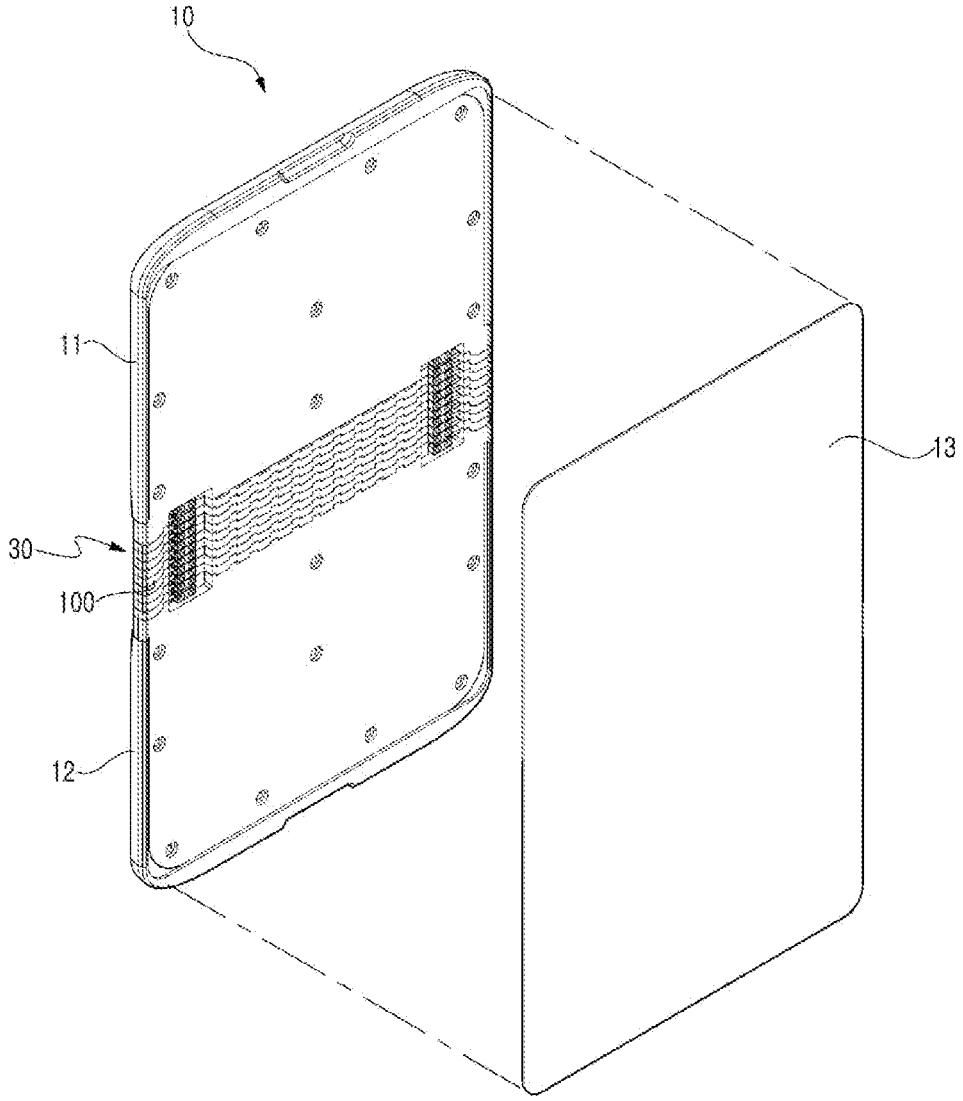
FIGS. 1, 2, 3 and 4 are views showing a use state of a flexible hinge device according to an embodiment of the present invention.
Figure 2:
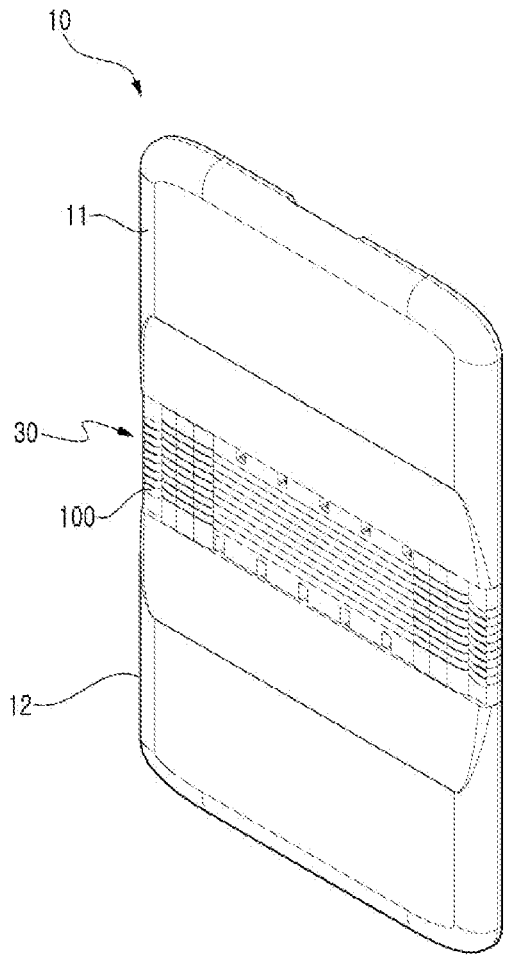
Figure 3:
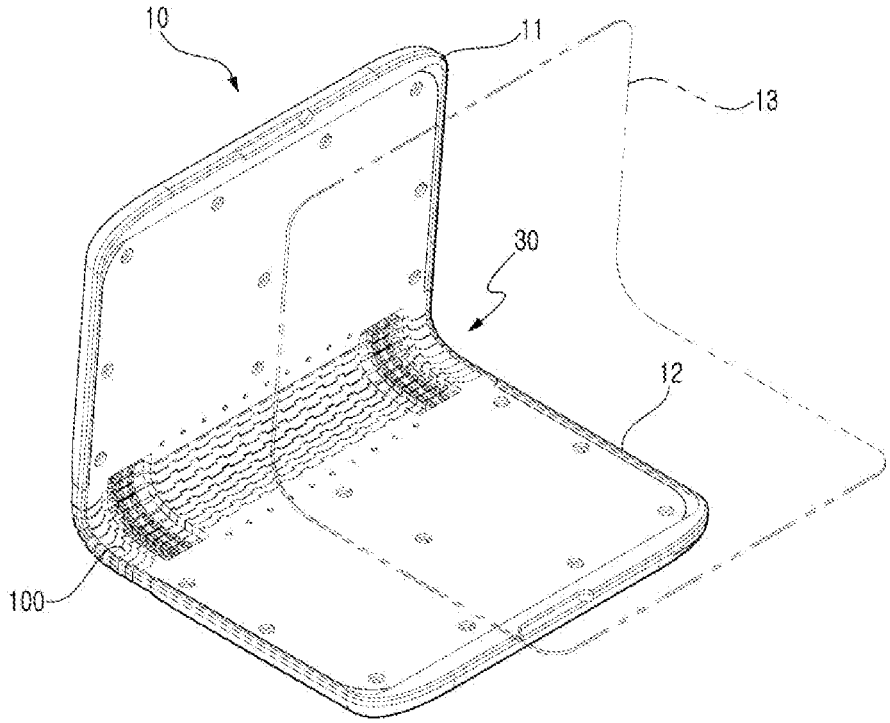

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

As shown in FIGS. 1 to 4, a flexible hinge device 10 having a cooperative operating structure according to an embodiment of the present invention includes a hinge unit 30 that interconnects a first plate 11 and a second plate 12 each having a top surface to which a flexible display screen 13 is attached, and is operated in a foldable manner so as to be bent or stretched.

The hinge unit 30 includes a plurality of segmental members 100 connected to one another by a cooperative operating means which will be described later to allow the hinge unit 30 to be bent or stretched, and the first plate 11 and the second plate 12 are respectively coupled to the outermost segmental members positioned at both ends of the plurality of segmental members 100.

Figure 8:
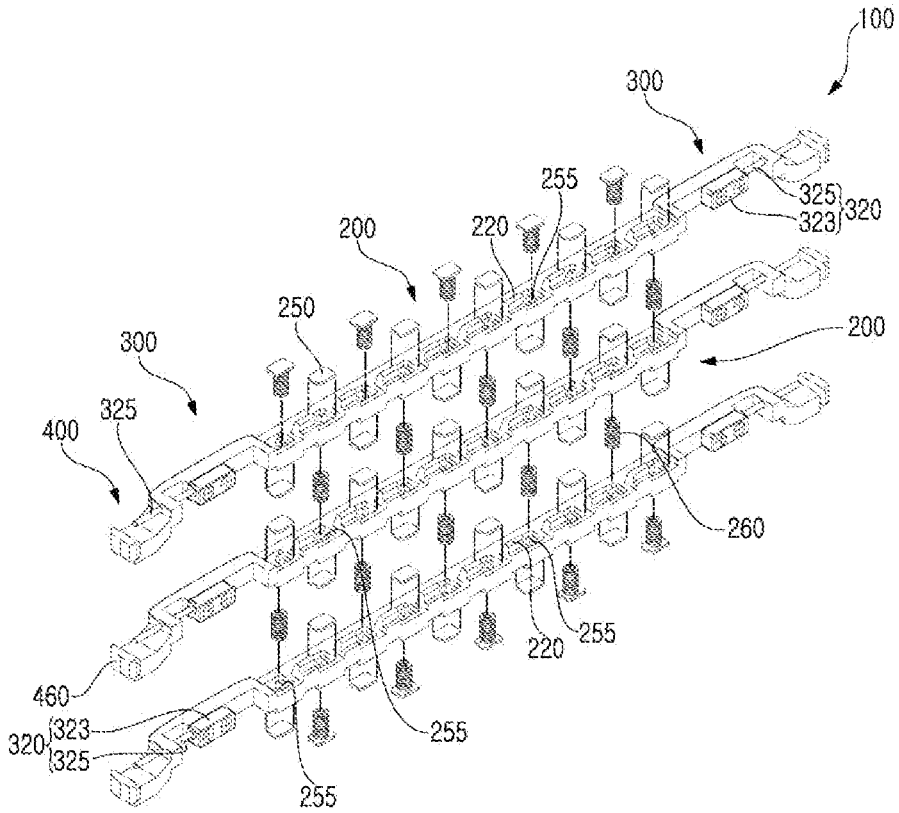
FIGS. 8 and 9 are exploded perspective views showing a segmental member according to an embodiment of the present invention.
Figure 9:
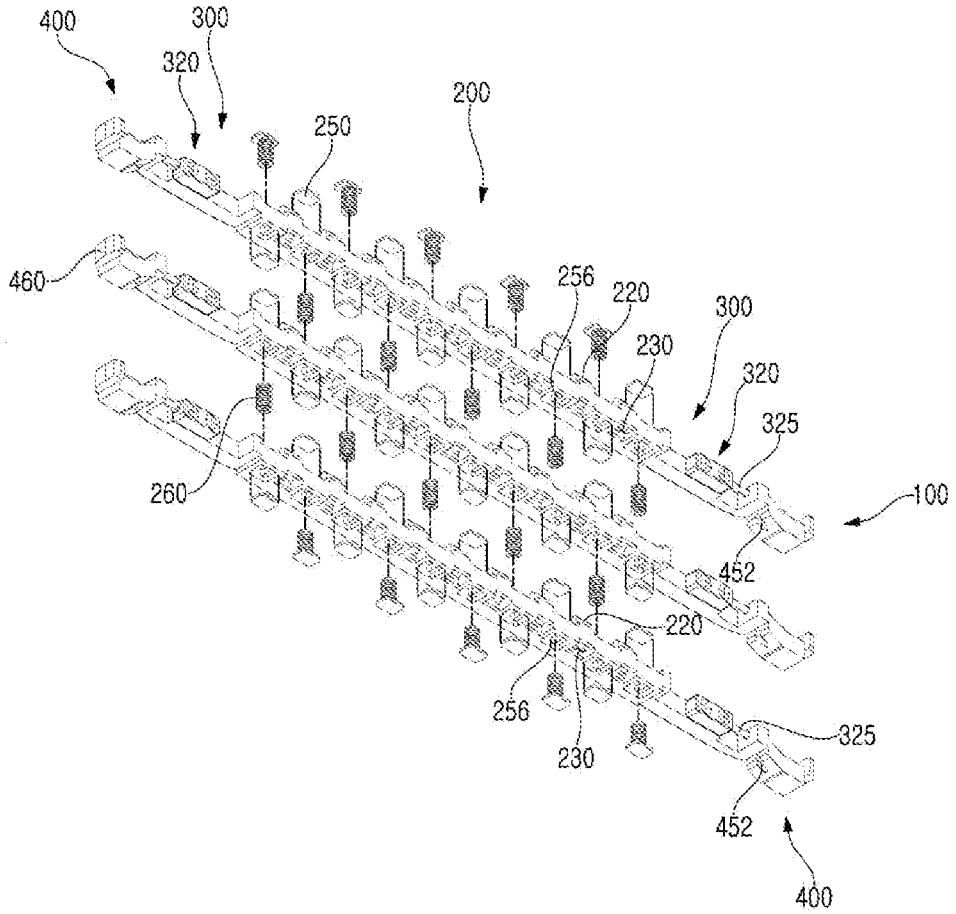

As shown in FIGS. 8 and 9, each of the segmental members 100 has an elongated rod shape, and includes a cam part 200, a fixing part 300, and a rotary part 400.

The cam part 200 is positioned at a central portion of the segmental member 100, has a longitudinally extended shape, and includes a cam nose 220 and a cam hole 230 formed at an upper portion and a lower portion thereof, which will be described later.

A pair of opposed fixing parts 300 are extendingly formed inwardly of both ends of the cam. part 200 in such a manner as to be spaced apart from each other by a uniform interval. A fixing member 320 is coupled to the fixing part 300, which will be described later.

A pair of opposed rotary parts 400 are extendingly formed outwardly of one ends of the fixing members 300 in such a manner as to be spaced apart from each other by a uniform interval. The rotary part 400 has an elongated hole 452 formed therein so as to allow the pin 325 of the fixing member 320 which will be described later to be rotatably inserted thereto. The rotary parts 400 corresponds to the outermost portions of the flexible hinge device 10, and each rotary part 400 includes a stop member 460 formed at one distal end thereof so as to increase aesthetic appreciation of design and reinforce durability.

A tension member 260 in the constituent elements of the cam part 200 will be described hereinafter with reference to FIGS. 8 and 9.

A plurality of cam noses 220 are continuously formed protrudingly at an upper portion of the cam part 200 in such a manner as to be spaced apart from each other at uniform intervals. The cam part 200 includes a plurality of upper fixing grooves 255 formed at the remaining portion of the upper portion thereof except the portions where the plurality of cam noses 220 are formed.

The cam part 200 includes a plurality of cam holes 230 formed at a lower portion thereof to vertically correspond to the cam noses 220. The cam part 200 includes a plurality of lower fixing grooves 256 formed at the remaining portion of the lower portion thereof except the portions where the plurality of cam holes 230 are formed. In other words, the upper fixing grooves 255 are formed to vertically correspond to the lower fixing grooves 256.

In addition, a tension member 260 such as a coil spring and a spiral spring interconnects an upper fixing groove 255 and a lower fixing groove 256 of the cam part 200, which is positioned in proximity to the upper fixing groove 255. The upper fixing grooves 255 and the lower fixing grooves 256 has retaining projections (not shown) formed therein so as to allow the tension springs 260 to be coupled to the upper fixing grooves 255 and the lower fixing grooves 256 therethrough.

Herein, the tension members 260 interconnect the upper fixing grooves 255 positioned in even rows and the lower fixing grooves 256 positioned in even rows of the cam part 200 in proximity to the upper fixing grooves 255. In addition, the tension members 260 interconnect the upper fixing grooves 255 positioned in odd rows and the lower fixing grooves 256 positioned in odd rows of the cam part 200 in proximity to the upper fixing grooves 255.

In other words, the tension members 260 interconnect the upper fixing grooves 255 and the lower fixing grooves 256 which are positioned in even rows, and the upper fixing grooves 255 and the lower fixing grooves 256 which are positioned in odd rows in an alternately arranged manner in the cam parts 200 connected in parallel with each other.

The aim of arranging the tension members 260 in the above-mentioned manner is to bend the plurality of segmental members 100 at the same angle by virtue of a tensile force of tension members 260, which is dispersed when the hinge unit 30 is bent.

In addition, a cover plates 250 is attached to each of the remaining upper fixing grooves 255 or lower fixing grooves 256 except the upper fixing grooves 255 or lower fixing grooves 256 to which the tension members 260 are connected. The reason for this is to neatly arrange the remaining upper or lower fixing grooves 255 or 256 to which the tension members 260 are connected.

Moreover, all the upper or lower fixing grooves 255 or 256 to which the cover plates 250 are attached may be connected by the tension members 260, but the tension members 260 are preferably alternately connected to the upper and lower fixing grooves 255 and 256 positioned in even or odd rows in view of a problem in that the manufacture cost is increased and the manufacture process is complicated.

Figure 5:
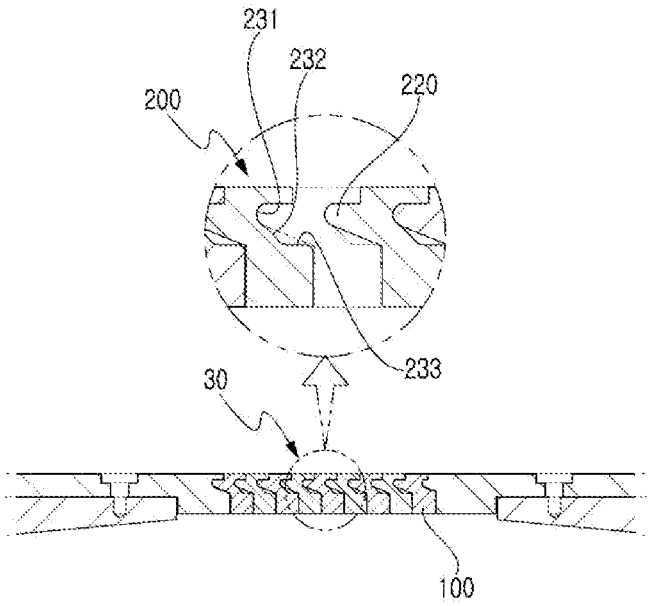
FIGS. 5, 6 and 7 are cross-sectional views showing a cam part according to an embodiment of the present invention.
Figure 6:
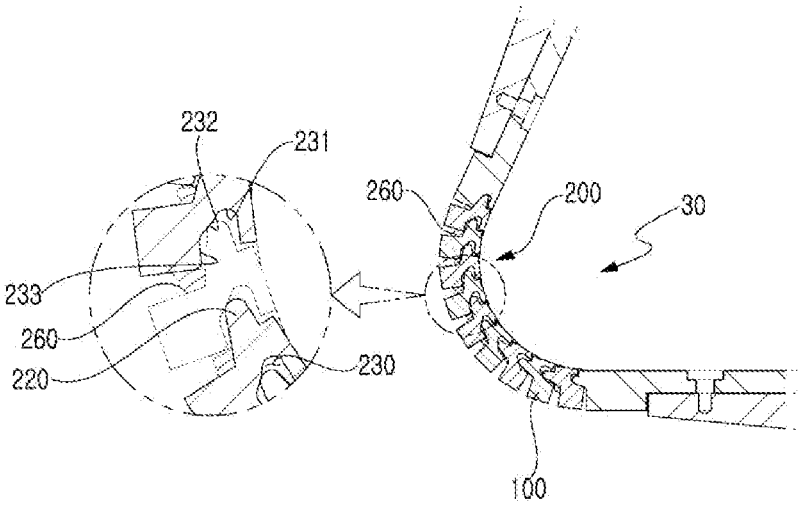
Figure 7:
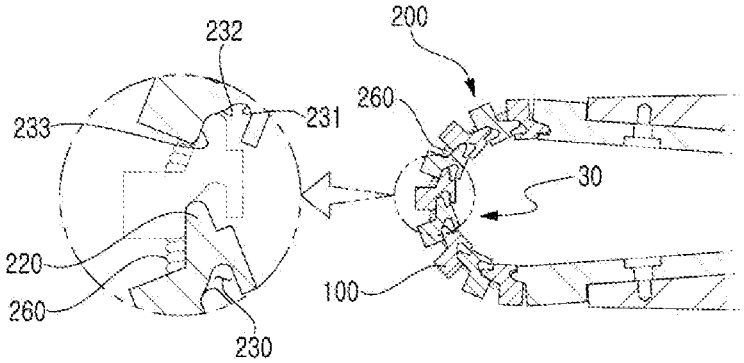

FIGS. 5 to 7 are cross-sectional views showing a cam part according to an embodiment of the present invention.

The structure and operation of the cam nose 220 and the cam hole 230 in the constituent elements of the cam part 200 will be described hereinafter with reference to FIGS. 5 to 9.

First, as described above, the plurality of cam noses 220 are formed continuously formed protrudingly at an upper portion of the cam part 200 in such a manner as to be spaced apart from each other at uniform intervals, and the plurality of cam holes 230 are formed at a lower portion of the cam part 200 to vertically correspond to the cam noses 220.

The structure of the cam hole 230 is as follows (see FIGS. 5 to 7).

Each of the cam hole 230 has an insertion hole 231 formed at an upper portion thereof so as to allow a cam nose 220 of another cam part 200 connected to a lower portion of the cam part 200 to be inserted into the insertion hole. Each of the cam holes 230 has a gently convex flexure 232 formed at the central portion thereof so as to allow the cam nose 220 to slide along the flexure.

In addition, the cam hole 230 has a seating hole 233 formed at a lower portion thereof so as to allow the cam nose 220 to be seated in the seating hole.

First, as shown in FIG. 5, when the hinge unit 30 is oriented in a horizontal direction, all the cam parts 20 of the plurality of segmental members 100 are also oriented in the horizontal direction.

In this case, the cam nose 220 is positioned at the insertion hole 231 of a cam part 200 connected to an upper portion thereof. The plurality of segmental members 100 are brought into close contact with each other without any step by a tensile force of the tension member 260 that interconnects the upper fixing groove 255 and the lower fixing groove 256 to form a horizontal state.

In addition, as shown in FIG. 6, when the hinge unit is bent at approximately 90 degrees, the cam parts 200 of the plurality of segmental members 100 have a cooperative operability owing to the dispersed tensile force of the tension members 260 and are bent at a certain angle. In this case, if the number of the segmental members 100 is nine, each segmental member 100 is bent at approximately 10 degrees.

In this case, the cam nose 220 slides along the flexure 232 formed at the central portion of the cam hole 230 of the cam part 200 connected to an upper portion of the cam nose.

Thus, in the case where the segmental members 100 are oriented in a horizontal direction at an initial stage, the cam noses 220 slide along the flexures 232 and each of the plurality of segmental members 100 has a cooperative operability is bent while forming a slightly step unlike a state in which all the segmental members 100 are brought into close contact with each other.

As such, as shown in FIGS. 3 and 5 to 7, in case of a general flexible display device, when the hinge unit 30 is bent, a step occurs in length between the first plate 11 positioned at the outside of the flexible display device and the second plate 12 positioned at the inside of the flexible display device. In order to solve this problem, the general flexible display device separately include a variable means (not shown) for guiding the forward and rearward movement of the first plate 11 and the second plate 12. On the other hand, the flexible hinge device 10 having a cooperative operating structure according to the present invention can reduce a difference in length between the first and second plates 11 and 12 and the flexible display screen 13 using only a configuration of the hinge unit 30 without an additional variable means through the structure and operation of the cam hole 230 having the cam nose 220 and the flexure 232.

In addition, as shown in FIG. 7, when the hinge unit 30 is bent at approximately 180 degrees, the cam parts 200 of the plurality of segmental members 100 have a cooperative operability owing to the dispersed tensile force of the tension members 260 and are bent at the maximum angle. In this case, if the number of the segmental members 100 is nine, each segmental member 100 is bent at approximately 20 degrees.

In this case, the cam nose 220 passes the flexure 232 and then is seated in the seating hole 233 formed at the lower portion of the cam hole 230. In addition, each of the plurality of segmental members 100 has a cooperative operability while forming are a maximum step. Thus, the hinge unit 30 is bent at the maximum angle.

In addition, in the case where it is desired to bend the hinge unit 30 to cause the flexible hinge device 10 to be fixedly maintained in a folded state (see FIG. 4), a fixing means (not shown) such as a magnet or a button may be attached to distal ends of the first plate 11 and the second plate 12.

As shown in FIGS. 8 and 9, each of the segmental members 100 includes the fixing parts 300 extendingly formed inwardly of both ends of the cam part 200 in such a manner as to be spaced apart from each other by a uniform interval In addition, the fixing part 300 further includes a fixing member 320 coupled to a front surface thereof.

The fixing member 320 includes a head 323 and a pin 325 longitudinally extending from one end of the head 323. The head 323 is coupled to the front surface of the fixing part 300 by a fastening means such as a screw or a press-fit manner so as to allow the pin 325 to be oriented outwardly.

The pin 325 is rotatably inserted into an elongated hole 452 of a stepped part 450 of another segmental member 100 connected to the upper portion of the through-part 420 through a through-part 420 of the rotary part 400 which will be described later. The rotation method of the pin 325 will be described hereinafter along with the structure of the rotary part 400.

Figure 10:
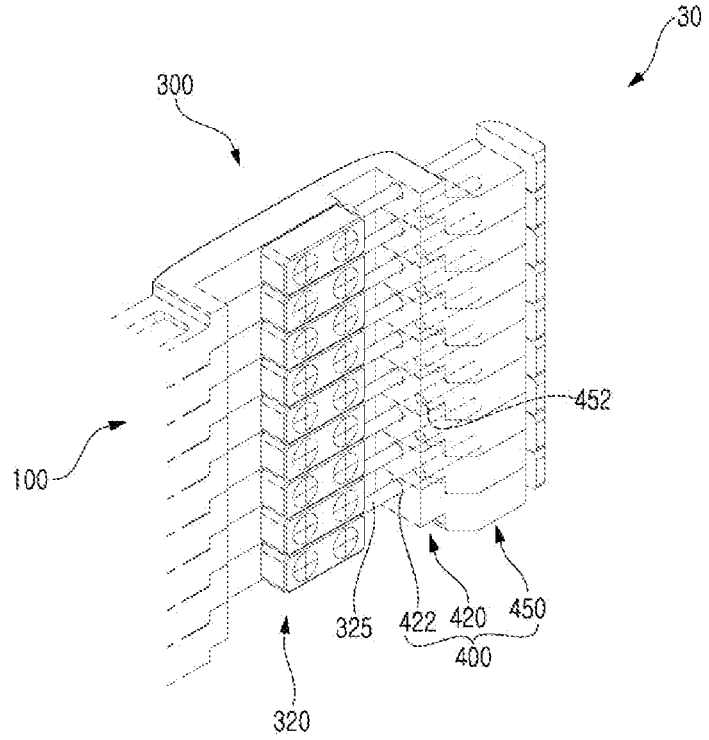
FIGS. 10 and 11 are perspective views showing a use state of a fixing part and a rotary part according to an embodiment of the present invention.
Figure 11:
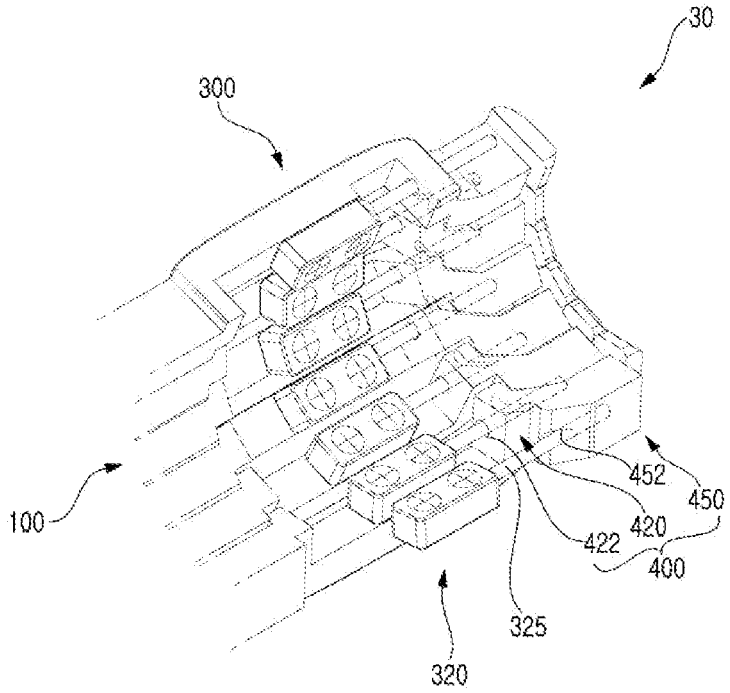

As shown in FIGS. 10 and 11, each of the segmental members 100 includes a pair of opposed rotary part 400 extendingly formed outwardly of one ends of the fixing members 300 in such a manner as to be spaced apart from each other by a uniform interval.

The rotary part 400 includes a through-part 420 having a through-hole 422 formed therein, and a stepped part 450 formed at an outer lower portion of the through-part 420. The stepped part 450 includes an elongated hole 452 formed therein to have a gentle curve.

The pin 325 of the fixing member 320 coupled to the fixing part 300 is rotatably inserted into an elongated hole 452 of a stepped part 450 of another rotary part 400 connected to the upper portion of the through-part 420 through the through-hole 422 formed at the through-part 420. In other words, the plurality of segmental members 100 can be doubly interconnected through the interconnection of the plurality of cam parts 200 by the tension members 260 of the cam parts 200 as described above, and the rotatable insertion of the pin 325 of the fixing member 320 into the elongated hole 452 of the stepped part 450 of another rotary part 400 connected to the upper portion of the through-part 420.

As shown in FIGS. 10 and 11, first, in the case where the hinge unit 30 of the flexible hinge device 10 according to an embodiment of the present invention is oriented in a horizontal direction, all the rotary parts 400 of the plurality of segmental members 100 are also oriented in the horizontal direction by the tensile force of the tension members 260. In this case, the pin 325 is positioned at an upper portion of an elongated hole 452 of another rotary part 400 connected to an upper portion of the rotary part.

In addition, when the hinge unit 30 is bent at approximately 90 degrees, the pint 325 is positioned at the central portion of the elongated hole 452, and when the hinge unit 30 is bent at approximately 180 degrees, the pint 325 is positioned at the lower portion of the elongated hole 452.

In other words, as the pin 325 is bent gradually, it is rotated while forming a gentle curve from the upper portion of the elongated hole 452 of another rotary part 400 connected to an upper portion of the rotary part to the lower portion thereof.

Figure 12:
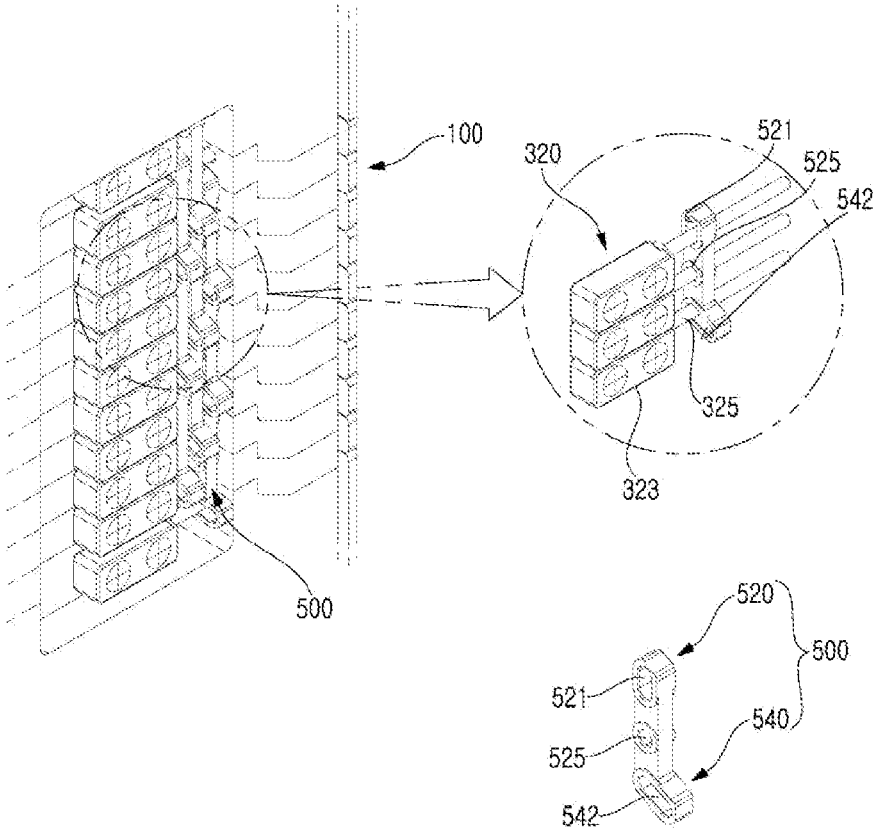
FIGS. 12 and 13 are perspective views showing a use state of a link member according to an embodiment of the present invention.
Figure 13:
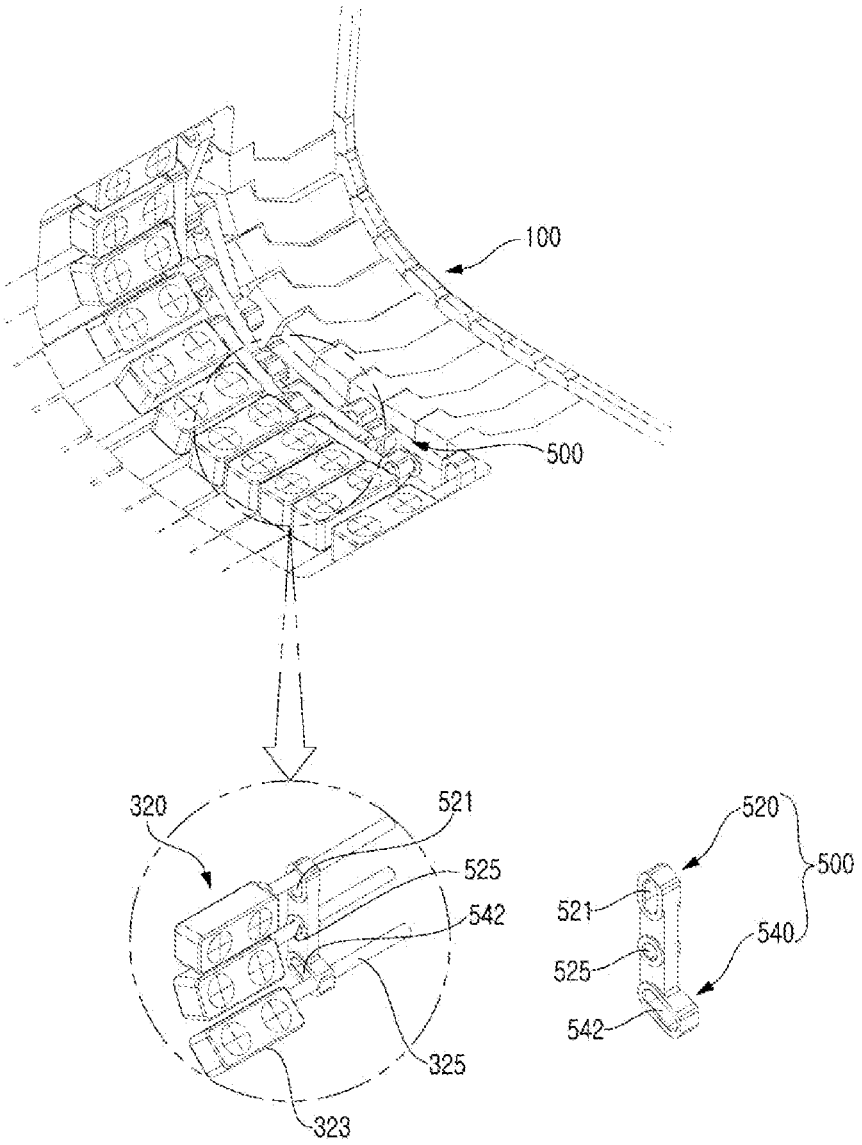

As shown in FIGS. 12 and 13, a plurality of link members 500 may be rotatably coupled to the pins 325 between the head 323 and the through-parts 420 to form a continuously constant layer.

As such, the cooperative operability can be obtained in which each of the segmental members 100 is bent at the same angle by only the dispersed tensile force of the tension member 260, but the link members 500 can be coupled to the pins to further reinforce a cooperative operating function in which each of the segmental members 100 is bent at the same angle.

Each of the link member 500 includes a vertical part 520 and an inclined part 540 extending inclinedly downwardly from a lower portion of the vertical part 520. The vertical part 520 of the link member 500 includes a central hole 525 formed at a lower portion thereof so as to allow the pin 325 to pass through the central hole, and a first elongated hole 521 formed at an upper portion thereof. In addition, a pin 325 of another fixing member 320 positioned above the pin 325 is rotatably passed through the first elongated hole 521.

The inclined part 540 of the link member 500 includes a second elongated hole 542 formed therein so that a pin 325 of another fixing member 320 positioned below the pin 325 is rotatably passed through the second elongated hole 542.

The operation of the link member 500 is as follows (based on the link member 500 coupled to a right side of the hinge unit 30).

As show in FIG. 12, when the hinge unit 30 is oriented in a horizontal direction, a pin 325 of another fixing member 320 positioned above the pin 325 passing through the central hole 525 is positioned at a lower portion of the first elongated hole 521.

In addition, a pin 325 of another fixing member 320 positioned below the pin 325 passing through the central hole 525 is positioned at an upper portion of the second elongated hole 542.

Further, as shown in FIG. 13, when the hinge unit 30 is bent at a certain angle or a maximum angle, a pin 325 of another fixing member 320 positioned above the pin 325 passing through the central hole 525 is positioned at an upper portion of the first elongated hole 521.

In addition, a pin 325 of another fixing member 320 positioned below the pin 325 passing through the central hole 525 is positioned at a lower portion of the second elongated hole 542 which is inclined downwardly.

In other words, as the hinge unit 30 is bent gradually, a pin 325 of another fixing member 320 positioned above the pin 325 is moved from the lower portion of the first elongated hole 521 to the upper portion thereof. In this case, a pin 325 of another fixing member 320 positioned below the pin 325 is inclinedly moved from the upper portion of the second elongated hole 542 to the lower portion thereof.

Besides the cooperative operability by the tension members 260 as described above, the plurality of link members 500 are additionally provided so that a cooperative operating function can be further reinforced in which each of the segmental members 100 is bent at the same angle.

Hereinafter, the key idea of the entire operation of the flexible hinge device 10 having a cooperative operating structure according to an embodiment of the present invention will be described.

As shown in FIGS. 5 and 10, when the hinge unit 30 is oriented in a horizontal direction, the plurality of segmental members 100 are pulled in a horizontally contacted state without any step by the tensile force of the tension members 260, and the pin 325 is positioned at an upper portion of an elongated hole 452 of another rotary part 400 connected to the upper portion of the rotary part 400. In addition, as shown in FIG. 12, a pin 325 of another fixing member 320 positioned above the pin 325 passing through the central hole 525 is positioned at a lower portion of the first elongated hole 521, and a pin 325 of another fixing member 320 positioned below the pin 325 is positioned at an upper portion of the second elongated hole 542.

As shown in FIGS. 6 and 11, when the hinge unit 30 is bent at a certain angle, each of the segmental members 100 is bent at the same angle by only the dispersed tensile force of the tension member 260, and the plurality of segmental members 100 are bent to form a slight step while the can nose 220 is moved slidably along the flexure 232 formed at the central portion of the cam hole 230. In this case, the pin 325 is positioned at the central portion of the elongated hole 452. In addition, as shown in FIG. 13, a pin 325 of another fixing member 320 position above the pin 325 is moved from the lower portion of the first elongated hole 521 to the upper portion thereof, and a pin 325 of another fixing member 320 position below the pin 325 is inclinedly moved from the upper portion of the second elongated hole 542 to the lower portion thereof.

As shown in FIGS. 7 and 11, when the hinge unit 30 is bent at the maximum angle, the cam nose 220 is seated in the seating hole 233 formed at the lower portion of the cam. hole 230, and the plurality of segmental members 100 are bent to form the maximum step. In this case, the pin 325 is positioned at the lower portion of the elongated hole 452. In addition, as shown in FIG. 13, a pin 325 of another fixing member 320 positioned above the pin 325 passing through the central hole 525 is positioned at an upper portion of the first elongated hole 521, and a pin 325 of another fixing member 320 positioned below the pin 325 is positioned at a lower portion of the second elongated hole 542.

Figure 4:
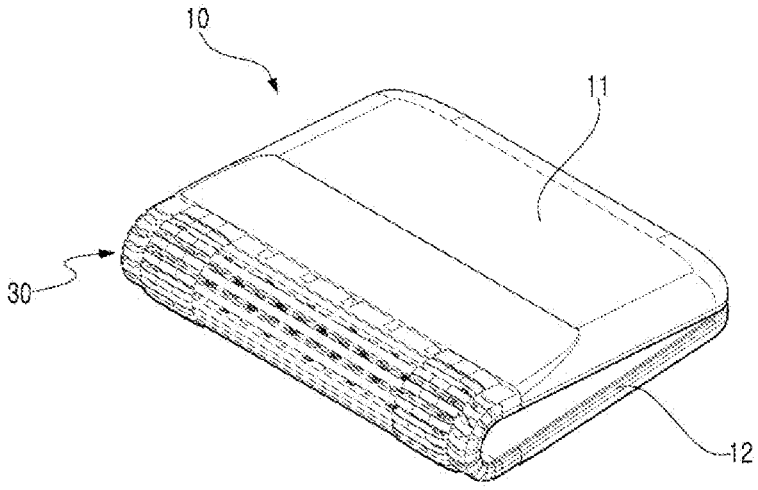

In addition, as described above, in the case where it is desired to bend the hinge unit 30 to cause the flexible hinge device 10 to be fixedly maintained in a folded state, a fixing means (not shown) such as a magnet or a button may be attached to distal ends of the first plate 11 and the second plate 12 (see FIG. 4).

INDUSTRIAL APPLICABILITY

The flexible hinge device having a cooperative operating structure of the present invention can reduce a difference in length between the first and second plates and the flexible display screen using only a configuration of the hinge unit without an additional variable means. In addition, each of the segmental members constituting the hinge unit can be bent at the same angle by virtue of the dispersed tensile force of the plurality of the tension member and the function of the link member.

While the present invention has been described in connection with the specific embodiments illustrated in the drawings, they are merely some embodiments for carrying out the flexible hinge device having a cooperative operating structure according to the present invention.

It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A flexible hinge device having a cooperative operating structure, comprising:

a first plate and a second plate each having a top surface to which a flexible display screen having flexibility is attached; and a hinge unit configured to interconnects the first plate and the second plate and configured to be operated in a foldable manner so as to be bent or stretched, wherein the hinge unit comprises a plurality of segmental members pivotally connected to one another to allow the hinge unit to be bent or stretched, the first plate and the second plate are respectively coupled to the outermost segmental members positioned at both ends of the plurality of segmental members, and wherein each of the segmental members comprises:

a longitudinally extended cam part;

a pair of opposed fixing parts extendingly formed inwardly of both ends of the cam part in such a manner as to be spaced apart from each other by a uniform interval;

a pair of opposed fixing members each including a head and a pin longitudinally extending from one end of the head; and a pair of opposed rotary parts extendingly formed outwardly of one ends of the fixing members in such a manner as to be spaced apart from each other by a uniform interval.

2. The flexible hinge device according to claim 1, wherein the cam part comprises:

one or more cam noses continuously formed protrudingly at an upper portion thereof in such a manner as to be spaced apart from each other at uniform intervals; and one or more cam holes formed at a lower portion thereof to vertically correspond to the cam noses.

3. The flexible hinge device according to claim 2, wherein each of the cam holes comprises:

an insertion hole portion formed at an upper portion thereof so as to allow a cam nose of another cam part connected to a lower portion of the cam part to be inserted into the insertion hole;

a flexure formed at the central portion thereof so as to allow the cam nose to slide along the flexure; and a seating hole portion formed at a lower portion thereof so as to allow the cam nose to be seated in the seating hole.

4. The flexible hinge device according to claim 2, wherein the cam part comprises:

one or more upper fixing grooves formed between the cam noses;

one or more lower fixing grooves formed between the cam holes; and one or more tension members configured to interconnect the upper fixing grooves and the lower fixing grooves of another cam part, which are positioned in proximity to the upper fixing grooves.

5. The flexible hinge device according to claim 4, wherein the tension members interconnect the upper fixing grooves positioned in even or odd rows and the lower fixing grooves positioned in even or odd rows of another cam part in proximity to the upper fixing grooves.

6. The flexible hinge device according to claim 1, wherein the head is coupled to a front surface of each said fixing part so as to allow the pin to be oriented outwardly.

7. The flexible hinge device according to claim 1, wherein the rotary part comprises:

a through-part having a through-hole formed therein; and a stepped part formed at an outer lower portion of the through-part, wherein the stepped part comprises an elongated hole formed therein to have a gentle curve.

8. The flexible hinge device according to claim 7, wherein the pin is rotatably inserted into an elongated hole of a stepped part of another rotary part connected to the upper portion of the through-part through the through-hole.

9. The flexible hinge device according to claim 8, wherein one or more link members are rotatably coupled to the pins between the heads and the through-parts to form a continuously constant layer, wherein each of the link members comprises a vertical part and an inclined part extending inclinedly downwardly from a lower portion of the vertical part, wherein the vertical part comprises:

a first elongated hole formed at an upper portion thereof so as to allow a pin of a fixing member positioned above the fixing member to pass through the first elongated hole; and a central hole formed at a lower portion thereof so as to allow the pin to pass through the central hole, and wherein the inclined part comprises a second elongated hole formed therein so as to allow a pin of a fixing member positioned below the fixing member to pass through the second elongated hole.

* * * * *